US005252254A

United States Patent [19]

Babaian-Kibala

[11] Patent Number: 5,252,254

[45] Date of Patent: Oct. 12, 1993

[54] NAPHTHENIC ACID CORROSION INHIBITOR

[75] Inventor: Elizabeth Babaian-Kibala, Fulshear, Tex.

[73] Assignee: Nalco Chemical Company, Naperville, Ill.

[21] Appl. No.: 998,437

[22] Filed: Dec. 30, 1992

[51] Int. Cl.[5] ..... C23F 11/16

[52] U.S. Cl. ..... 252/393; 252/395; 422/12; 106/14.05; 208/47; 208/263

[58] Field of Search ..... 252/393, 395, 404, 406; 422/12; 106/14.05, 14.13; 208/47, 90, 98, 263

[56] References Cited

U.S. PATENT DOCUMENTS 2,656,380 10/1953 Turner ..... 208/263

4,941,994 7/1990 Zetlmeisl et al. ..... 252/389.23

OTHER PUBLICATIONS

Gutzeit, *Materials Performance,* pp. 24–35, Oct., 1977.

Piehl, NACE Corrosion 87 Meeting, Paper No. 196, Mar. 9–13, 1987.

Scattergood et al., NACE Corrosion 87 Meeting, Paper No. 197, Mar. 9–13, 1987.

Gustavsen et al., NACE Corrosion 89 Meeting, Paper No. 449, Apr. 17–21, 1989.

*Primary Examiner*—Robert L. Stoll

*Assistant Examiner*—Valerie Fee

*Attorney, Agent, or Firm*—Robert A. Miller; Daniel N. Lundeen; Andrew S. Pryzant

[57] ABSTRACT

Sulfonated alkylphenol is added to crude oil at 5 to 200 ppm to inhibit naphthenic acid corrosion of ferrous metal process piping and equipment in contact with the crude oil at naphthenic acid corrosion conditions. There are disclosed corrosion-inhibited hydrocarbon fluids, an improvement in hot hydrocarbon processing with sulfonated alkylphenol, a method for inhibiting naphthenic acid corrosion therewith, and a method for catalytically processing hydrocarbons with sulfonated alkylphenol to avoid catalyst poisoning by iron compounds.

8 Claims, No Drawings

NAPHTHENIC ACID CORROSION INHIBITOR

FIELD OF THE INVENTION

This invention relates to inhibitors for naphthenic acid corrosion control in hot hydrocarbon fluids, and more particularly to the use of sulfonated alkylphenol as an inhibitor of naphthenic acid corrosion.

BACKGROUND OF THE INVENTION

It is widely known in the art that the processing of crude oil and its various fractions has led to damage to piping and other associated equipment due to naphthenic acid corrosion. Generally speaking, naphthenic acid corrosion occurs when the crude being processed has a neutralization number or total acid number (TAN), expressed as the milligrams of potassium hydroxide required to neutralize the acids in a one gram sample, above 0.2. It is also known that naphthenic acid corrosion is more severe when the naphthenic acid-containing hydrocarbon is at a temperature between about 200° C. and 400° C. (approximately 400° F.–750° F.), and also when fluid velocities are high or liquid impinges on process surfaces e.g. in transfer lines, return bends and restricted flow areas. Additional background on the problem of naphthenic acid corrosion in oil refineries can be found in Gutzeit, *Materials Performance*, pp. 24–35, October, 1977; Piehl, NACE Corrosion 87 Meeting, Paper No. 196, Mar. 9–13, 1987; and Scattergood et al., NACE Corrosion 87 Meeting, Paper No. 197, Mar. 9–13, 1987.

Various approaches to controlling naphthenic acid corrosion have included neutralization and/or removal of naphthenic acids from the crude being processed; blending low acid number oils with corrosive high acid number oils to reduce the overall neutralization number; and the use of relatively expensive corrosion-resistant alloys in the construction of the piping and associated equipment. These attempts are generally disadvantageous in that they require additional processing and/or add substantial costs to treatment of the crude oil. Alternatively, various amine and amide based corrosion inhibitors are commercially available, but these are generally ineffective in the high temperature environment of naphthenic acid corrosion. U.S. Pat. No. 4,941,994 to Zetlmeisl et al. discloses a naphthenic acid corrosion inhibitor comprising a dialkyl or trialkyl phosphite in combination with an optional thiazoline. However, phosphorous compounds are known to impair the function of various catalysts used to treat crude oil, e.g. in fixed-bed hydrotreaters and hydrocracking units. Crude oil processors are often in a quandary since if the phosphite stabilizer is not used, then iron can accumulate in the hydrocarbon up to 10 to 20 ppm and impair the catalyst.

Naphthenic acid corrosion is readily distinguished from conventional rusting and other types of corrosion. Naphthenic acid corrosion occurs in a non-aqueous environment and produces a characteristic grooving of the metal in contact with the corrosive stream that seems to distinguish it from high temperature sulfur attack. Rusting, on the other hand, is generally caused by water in contact with the steel surface in an oxidizing environment. Thus, various sulfonates, primarily metal and amine salts of aromatic sulfonic acids, e.g., dodecylbenzene and dinonylnaphthalene, have been used to treat metal surfaces to protect them from corrosion caused by contact with moisture and air by forming a rust preventive coating on the metal surface. In general, the coating includes a polar layer tightly bound to the metal surface by chemisorption, and a non-polar or barrier layer, generally a hydrophobic material, which blocks corrosive molecules such as oxygen and water from getting to the metal surface. See, Gustavsen et al., NACE Corrosion 89 meeting, paper no. 449, Apr. 17–21, 1989. However, conventional rust preventives such as dodecylbenzene sulfonate and dinonylnaphthalene sulfonate are generally ineffective for inhibiting naphthenic acid corrosion.

Accordingly, it would be very desirable to have available a naphthenic acid corrosion inhibitor which is both effective at naphthenic acid corrosion temperatures and suitable for use in hydrocarbons being processed with a catalyst.

SUMMARY OF THE INVENTION

The present invention involves the discovery that sulfonated alkyl-substituted phenol is a very effective naphthenic acid corrosion inhibitor when present in very low concentrations in a hydrocarbon fluid or stream containing naphthenic acid. This surprising discovery makes it possible to inhibit the corrosive effects of hydrocarbons having relatively high naphthenic acid contents without the need for expensive corrosion-resistant alloys to be used in the process piping and equipment, or other pretreating of the hydrocarbon stock specifically for inhibiting naphthenic acid corrosion, e.g. neutralization or blending. The present invention also provides a longer catalyst life in hydrotreaters and hydrocracking units since the iron content of the hydrocarbon can be reduced and the sulfonated alkylphenol is not a catalyst poison. The present invention thus addresses naphthenic acid corrosion in crude oil and most other hydrocarbon process streams in a refinery.

In one aspect, the invention provides an improvement to a process in which a hydrocarbon fluid containing a corrosive amount of naphthenic acid contacts a ferrous metal surface. The improvement is characterized by the hydrocarbon fluid containing a corrosion-inhibiting amount of sulfonated alkylphenol.

In another aspect, the invention provides a composition of matter which includes a hydrocarbon fluid containing a corrosive amount of naphthenic acid, and sulfonated alkylphenol intimately mixed therewith in an amount effective to inhibit naphthenic acid corrosion.

In a further aspect, the invention provides a method for inhibiting naphthenic acid corrosion of ferrous surfaces in contact with a hot hydrocarbon fluid. The method includes the step of adding a sulfonated alkylphenol to the hydrocarbon fluid in an amount effective to form a corrosion-inhibiting barrier layer on the metal surfaces in contact with the fluid. The method then includes the step of maintaining sufficient sulfonated alkylphenol in the hydrocarbon fluid in contact with the metal surfaces to maintain the corrosion-inhibiting barrier layer. Accordingly, the metal surfaces in the refinery process piping and equipment can be protected by introducing a relatively high initial dose of the sulfonated alkylphenol for a relatively short period of time, and then reducing the dosage rate to a maintenance level.

Another aspect of the invention includes a method for catalytically treating a hydrocarbon stream. The method includes the steps of: (a) adding a corrosion-inhibiting amount of sulfonated alkylphenol to a hydrocarbon stream containing a corrosive amount of naphthenic acid; (b) contacting metal surfaces of process piping with the corrosion-inhibited hydrocarbon stream; and (c) contacting hydrocarbon-treating catalyst with the corrosion-inhibited hydrocarbon stream downstream from the metal surfaces such that the hydrocarbon stream is substantially free of catalyst-poisoning amounts of iron compounds.

The invention is particularly suitable for use with hydrocarbon fluids comprising crude oil, a gas oil fraction, a light lubricating oil fraction, atmospheric tower bottoms, or vacuum tower bottoms, at an elevated temperature, e.g. between about 200° C. and 400° C. (approximately 400° F.–750° F.), and particularly where the hydrocarbon mixture or stream has an acid number of 0.2 or more. The sulfonated alkylphenol is preferably present at from 5 to 200 ppm. The alkyl moiety (or moieties) of the alkyl phenol preferably has from 4 to 20 carbon atoms, and the alkyl-substituted phenol is mostly sulfonated, preferably at least 70 percent sulfonated. Nonylphenol sulfonic acid has been found to be particularly effective in inhibiting naphthenic acid corrosion.

DETAILED DESCRIPTION OF THE INVENTION

The sulfonated alkylphenol useful in the present invention is generally obtained by sulfonating alkylphenol, such as, for example, by contacting the alkylphenol with sulfur trioxide or oleum. In general, some sulfated alkylphenol will be produced as a byproduct, but the product will be primarily the sulfonic acid of the alkylphenol. The degree of sulfonation/sulfation can be determined, for example, by titration with cyclohexylamine. Preferably, the sulfonated alkylphenol is at least about 70 percent sulfonated, more preferably at least 80 percent sulfonated.

The alkylphenol generally has at least one alkyl group but can include one or two additional alkyl groups, i.e., dialkylphenol or trialkylphenol, and the term "alkylphenol" is used herein collectively in reference to mono, di-, and tri-substituted alkylphenols. The alkyl group is necessary to confer solubility to the sulfonated alkylphenol in the generally non-aqueous hydrocarbon stream in which naphthenic acid corrosion is to be inhibited. Lower alkyl groups are generally less preferred because they confer only limited solubility in hydrocarbons. Large, bulky alkyl groups of virtually any size can theoretically be used, but there is generally no benefit and the effectiveness on a weight basis of the sulfonated alkylphenol generally decreases as the size of the alkyl group increases. The alkyl substituent can be branched or straight-chained as desired. Each alkyl group of the alkylphenol which is sulfonated preferably has independently from about 4 to about 20 carbon atoms. Nonylphenol sulfonic acid has been found to be particularly useful and is available commercially from Nalco Chemical Company.

The hydrocarbon streams which can be treated include crude oil and hydrocarbon fluids being processed, e.g., in a refinery, at elevated temperatures, especially at a temperature between about 200° C. and 400° C. (approximately 400° F.–750° F.). The sulfonated alkylphenol additive is particularly effective in inhibiting naphthenic acid corrosion in hydrocarbon fluids having a relatively high naphthenic acid content, e.g. an acid number above 0.2 or more. Naphthenic acid can be found in crude oil, but, due to the boiling temperature range of naphthenic acids, the acid is more frequently concentrated in gas oil and light lubricating oil fractions, atmospheric tower bottoms, vacuum tower bottoms, and like refinery products and intermediates. In general, any cut or bottoms of crude oil above 200° C. (392° F.) is potentially rich in naphthenic acid. Corrosion is more pronounced at acid numbers above 2.0, and acid numbers as high as 6 or 7 or more can occur.

The sulfonated alkylphenol can be used at an effective concentration in the hydrocarbon fluid to inhibit naphthenic acid corrosion. Generally, a sulfonated alkylphenol concentration of from about 1 to about 10,000 ppm or more can be effective, but a concentration of from 5 to 200 ppm is generally preferred to achieve the desired level of corrosion inhibition at a reasonable economy. In process piping and associated equipment, the sulfonated alkylphenol is preferably added to the hydrocarbon fluid in contact therewith at a relatively high initial concentration for a relatively short period of time to form a protective corrosion-inhibiting layer on the iron-containing metal surfaces exposed to the fluid. Thereafter, the dosage of the sulfonated alkylphenol can be reduced to a maintenance level required to maintain the protective barrier layer. The amount of sulfonated alkylphenol required to obtain the same general degree of corrosion inhibition usually increases as the velocity of the hydrocarbon fluid increases. Thus, at relatively high velocities, generally found in transfer lines, return bends and restricted flow areas, for example, an initial concentration of 60 to 200 ppm may be used to deposit the initial barrier layer, and a reduced concentration of sulfonated alkylphenol at 10 to 40 ppm can be used for maintenance. However, in low velocity hydrocarbon fluids, the initial concentration to obtain a protective barrier layer can be at 20 to 40 ppm, for example, with a 5 to 15 ppm maintenance level.

The sulfonated alkylphenol can be added to the hydrocarbon fluid in which naphthenic acid corrosion is to be inhibited at any convenient point, e.g. by metering the appropriate amount of the sulfonated alkylphenol into the hydrocarbon fluid. Preferably, the sulfonated alkylphenol is added as a concentrated master batch of 10 to 75 weight percent sulfonated alkylphenol in an appropriate solvent, such as, for example, mineral oil, aliphatic and aromatic solvents, naphtha, toluene, benzene or the like. The sulfonated alkylphenol can be added to the hydrocarbon fluid using any conventional equipment which intimately mixes the sulfonated alkylphenol with the hydrocarbon fluid. A vessel or tank with agitation, for example, a mechanical stirrer, is all that is required, but the additive can also be metered into hydrocarbon fluid streams where turbulence in the piping and/or associated equipment thoroughly mixes the stream.

The use of sulfonated alkylphenol as a naphthenic acid inhibitor is particularly attractive when the hydrocarbon fluid is catalytically processed, for example, in a fixed-bed hydrotreater or hydrocracker. By maintaining an effective concentration of corrosion-inhibiting sulfonated alkylphenol according to the present invention, the hydrocarbon fluid can be treated with a catalyst without impairing the catalyst with excessive levels of iron corroded from the piping and equipment surfaces. In addition, the sulfonated alkylphenol is sulfur-based and will not impair the function of conventional stationary bed catalysts like phosphorus-based corrosion inhibitors can. Preferably, when the hydrocarbon fluid is treated with a catalyst the sulfonated alkylphenol is present in the hydrocarbon fluid in an amount effective to maintain an iron level below 10 ppm in the catalytic processing equipment; and in the case of stationary bed catalysts, the hydrocarbon is preferably also essentially free of other catalyst-impairing compounds.

The invention is illustrated by the following examples.

EXAMPLES

The nonylphenol sulfonic acid (NPSA) used in the following examples was obtained by reacting nonylphenol using a laboratory sulfonation unit including a glass thin-film falling reactor, a dual syringe pump for metering $SO_3$, and a gear pump for delivery of nonylphenol. The molar ratio of $SO_3$ to nonylphenol was between 0.81 and 2.0. Reactor and associated glassware temperature was controlled using circulating water baths. The product was analyzed for degree of sulfonation/sulfation by titration with cyclohexylamine and was determined to be about 80 percent sulfonated.

EXAMPLE 1

A hydrocarbon fluid was prepared by using viscous oil and commercially available naphthenic acid. The neutralization numbers were adjusted to be about 5.5. A slightly modified beaker test was used to analyze the inhibitor. A 2-liter, 4-neck round bottom flask equipped with a mechanical stirrer and a Dean-Stark trap connected to a condenser was used. The temperature was controlled by a temperature controller. The coupons were carbon steel. NPSA was introduced to the fluid under agitation at 93° C. (200° F.). The temperature was raised to 260° C. (500° F.) for 6 hours. The coupon was removed, excess oil rinsed, and the excess corrosion products were removed from the coupon using steel wool. The coupon was then weighed and percent inhibition and corrosion rate were calculated. Without the NPSA additive, the corrosion rate was 198 mils per year (MPY) or 5.03 mm/yr. At 10,000 ppm NPSA, the corrosion rate was only 48 MPY or 1.22 mm/yr, for an inhibition rate of 76 percent.

EXAMPLES 2-6

The procedure of Example 1 was followed except that crude oil, heavy vacuum gas oil (HVGO), and light gas oil (LGO) were used instead of viscous oil. The procedure was also used to compare the relative ineffectiveness of dodecylbenzene sulfonic acid (DDBSA) in crude oil at 0 and 100 ppm; and dialkylnapthalene sulfonic acid (DANSA) neutralized with cyclohexylamine (CHA) at 0 and 200 ppm in light gas oil. The results are presented along with the results of Example 1, in Table 1 below.

TABLE 1

| Example | Hydrocarbon Fluid | Acid Number (TAN) | Additive | Additive Content (ppm) | Corrosion Rate MPY | Corrosion Rate mm/yr | Corrosion Inhibition (%) |
|---|---|---|---|---|---|---|---|
| 1 | Viscous Oil | 5.5 | NPSA | 0 | 198 | 5.03 | 0 |
| | | | | 10,000 | 48 | 1.22 | 76 |
| 2 | Crude Oil | 3.5 | NPSA | 0 | 20 | 0.51 | 0 |
| | | | | 100 | 16 | 0.41 | 21 |
| 3 | HVGO | 4.5 | NPSA | 0 | 46 | 1.17 | 0 |
| | | | | 500 | 27 | 0.69 | 40 |
| 4 | LGO | 5.5 | NPSA | 0 | 67 | 1.70 | 0 |
| | | | | 200 | 35 | 0.89 | 50 |
| 5 | Crude Oil | 3.5 | DDBSA | 0 | 20 | 0.51 | 0 |
| | | | | 100 | 24 | 0.61 | −20* |
| 6 | LGO | 5.5 | DANSA/CHA | 0 | 67 | 1.70 | 0 |
| | | | | 200 | 59 | 1.50 | 12 |

*The corrosion rate was accelerated by DDBSA.

From the foregoing results, it is seen that NPSA is surprisingly effective in inhibiting naphthenic acid corrosion in various acidic hydrocarbon fluids. In contrast, the structurally similar compounds DDBSA and DANSA were comparatively ineffective at similar concentrations and conditions.

The invention is illustrated by way of the foregoing description and examples. The foregoing description is intended as a non-limiting illustration, since many variations will become apparent to those skilled in the art in view thereof. It is intended that all such variations within the scope and spirit of the appended claims be embraced thereby.

What is claimed is:

1. In a process comprising contacting a ferrous metal surface with a hydrocarbon fluid containing a corrosive amount of naphthenic acid, the improvement wherein the fluid contains a corrosion-inhibiting amount of sulfonated alkyl-substituted phenol.

2. A composition of matter, comprising:

a hydrocarbon fluid containing a corrosive amount of naphthenic acid; and sulfonated alkyl-substituted phenol intimately mixed therewith in an amount effective to inhibit naphthenic acid corrosion.

3. A method for inhibiting naphthenic acid corrosion of ferrous surfaces in contact with a hot hydrocarbon fluid, comprising:

adding a sulfonated alkyl-substituted phenol to the hydrocarbon fluid in an amount effective to form a corrosion-inhibiting barrier layer on the metal surfaces in contact with the fluid; and maintaining sufficient sulfonated alkylphenol in the hydrocarbon fluid to maintain the corrosion-inhibiting barrier layer.

4. A method of catalytically treating a hydrocarbon fluid, comprising:

adding a corrosion-inhibiting amount of sulfonated alkyl-substituted phenol to a hydrocarbon fluid containing a corrosive amount of naphthenic acid;

contacting metal surfaces of process piping with the corrosion-inhibited hydrocarbon fluid; and contacting hydrocarbon-treating catalyst with the corrosion-inhibited hydrocarbon fluid downstream from said metal surfaces, wherein the hydrocarbon fluid is substantially free of catalyst-impairing amounts of iron corrosion products.

5. The invention of any one of claims 1 through 4, wherein the hydrocarbon fluid comprises crude oil, a refinery gas oil fraction, a refinery light lubricating oil fraction, refinery atmospheric tower bottoms, or refinery vacuum tower bottoms, at a temperature between 200° C. and 400° C., having an acid number of 0.2 or more.

6. The invention of claim 5, wherein the alkyl substituent of the alkylphenol has from 4 to 20 carbon atoms and the alkylphenol is at least 70 percent sulfonated.

7. The invention of claim 5, wherein the sulfonated alkylphenol is present in the hydrocarbon fluid at from 5 to 200 ppm.

8. The invention of claim 7, wherein the sulfonated alkylphenol comprises nonylphenol sulfonic acid.

* * * * *